US010751999B2

(12) United States Patent
Fujimori et al.

(10) Patent No.: US 10,751,999 B2
(45) Date of Patent: Aug. 25, 2020

(54) ROLL WIPING MEMBER UNIT, WIPER CASSETTE, WIPER UNIT, LIQUID EJECTING APPARATUS, AND METHOD OF USING WIPING MEMBER

(71) Applicant: SEIKO EPSON CORPORATION, Tokyo (JP)

(72) Inventors: Ryoji Fujimori, Suwa (JP); Toshio Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 12 days.

(21) Appl. No.: 16/012,643

(22) Filed: Jun. 19, 2018

(65) Prior Publication Data

US 2018/0370240 A1 Dec. 27, 2018

(30) Foreign Application Priority Data

Jun. 21, 2017 (JP) ..... 2017-121401

(51) Int. Cl.
*B41J 2/165* (2006.01)

(52) U.S. Cl.
CPC ..... *B41J 2/16544* (2013.01); *B41J 2/16517* (2013.01); *B41J 2/16535* (2013.01); *B41J 2002/1655* (2013.01)

(58) Field of Classification Search
CPC B41J 2/16517; B41J 2/16535; B41J 2/16544; B41J 2002/1655
See application file for complete search history.

(56) References Cited

U.S. PATENT DOCUMENTS

2007/0068560 A1* 3/2007 Shang ..... B41J 2/16526 134/34
2008/0018677 A1* 1/2008 White ..... B41J 2/16526 347/5
2013/0120495 A1* 5/2013 Nakamura ..... B41J 2/16535 347/33
2013/0249998 A1* 9/2013 Kasahara ..... B41J 2/16505 347/31
2015/0146120 A1* 5/2015 Maida ..... B41J 2/16535 349/33
2017/0066244 A1 3/2017 Fujioka et al.

FOREIGN PATENT DOCUMENTS

JP 64-002964 1/1989
JP 03-286726 A 12/1991
JP 06-127098 A 5/1994
JP 2002-046904 A 2/2002

(Continued)

*Primary Examiner* — Kristal Feggins
*Assistant Examiner* — Kendrick X Liu
(74) *Attorney, Agent, or Firm* — Workman Nydegger

(57) ABSTRACT

A roll wiping member unit includes a long wiping member and a core. The long wiping member has a starting end and a terminating end at ends in a longitudinal direction and a wiping portion that is subjected to a tensile load at a position between the starting end and the terminating end. The long wiping member is configured to wipe a liquid ejecting head at the wiping portion. The long wiping member is wound on the core from the terminating end in a roll. The long wiping member has a weak portion having strength that does not withstand the tensile load at a position closer than the wiping portion to the terminating end.

14 Claims, 6 Drawing Sheets

(56) References Cited

FOREIGN PATENT DOCUMENTS

| | | | |
|---|---|---|---|
| JP | 2010-006518 | A | 1/2010 |
| JP | 2010-207728 | A | 9/2010 |
| JP | 2012-051142 | A | 3/2012 |
| JP | 2013-103376 | A | 5/2013 |
| JP | 2013-159008 | A | 8/2013 |
| JP | 2017-052117 | A | 3/2017 |

* cited by examiner

ROLL WIPING MEMBER UNIT, WIPER CASSETTE, WIPER UNIT, LIQUID EJECTING APPARATUS, AND METHOD OF USING WIPING MEMBER

BACKGROUND

1. Technical Field

The present invention relates to a roll wiping member unit, a wiper cassette, a wiper unit, a liquid ejecting apparatus, and a method of using a wiping member.

2. Related Art

In a known liquid ejecting apparatus, a long wiping member that has wiped a liquid ejecting head is wound up by a take-up roller, and the amount of the wiping member used is determined by the amount of rotation of the take-up roller (see, JP-A-2013-103376).

There may be a difference between the amount of rotation of the take-up roller and the amount of the wiping member used. In such a case, the take-up roller may rotate although there is no wiping member to be wound up. Thus, the liquid ejecting head is failed to be wiped in some cases. An advantage of some aspects of the invention is that a roll wiping member unit, a wiper cassette, a wiper unit, a liquid ejecting apparatus, and a method of using a wiping member, which reliably wipe a liquid ejecting head, are provided.

SUMMARY

A roll wiping member unit that solves the above-described problem includes a long wiping member and a core. The long wiping member has a starting end and a terminating end at ends in a longitudinal direction and a wiping portion that is subjected to a tensile load at a position between the starting end and the terminating end. The long wiping member is configured to wipe a liquid ejecting head that ejects liquid at the wiping portion. The long wiping member is wound on the core from the terminating end in a roll. The long wiping member has a weak portion having strength that does not withstand the tensile load at a position closer than the wiping portion to the terminating end.

A wiper cassette that solves the above-described problem includes a long wiping member, a feeding roller, a take-up roller, and a case. The long wiping member has a starting end and a terminating end at ends in a longitudinal direction and a wiping portion that is subjected to a tensile load at a position between the starting end and the terminating end. The long wiping member is wound from the terminating end in a roll. The feeding roller retains the long wiping member wound in a roll. The take-up roller is configured to take up the long wiping member from the starting end after the wiping portion wiped a liquid ejecting head that ejects liquid. The case rotatably retains the feeding roller and the take-up roller. The long wiping member has a weak portion having strength that does not withstand the tensile load at a position closer than the wiping portion to the terminating end.

A wiper unit that solves the above-described problem includes a wiper cassette and a wiper holder to which the wiper cassette is attached. The wiper cassette includes a long wiping member, a feeding roller, and a take-up roller, and a case. The long wiping member has a starting end and a terminating end at ends in a longitudinal direction and a wiping portion that is subjected to a tensile load at a position between the starting end and the terminating end. The long wiping member is wound from the terminating end in a roll. The feeding roller retains the long wiping member wound in a roll. The take-up roller is configured to take up the long wiping member from the starting end after the wiping portion wiped a liquid ejecting head that ejects liquid. The case rotatably retains the feeding roller and the take-up roller. The long wiping member has a weak portion having strength that does not withstand the tensile load at a position closer than the wiping portion to the terminating end.

A liquid ejecting apparatus that solves the above-described problem includes a liquid ejecting head configured to eject liquid and a wiper unit including a wiper cassette and a wiper holder to which the wiper cassette is attached. The wiper cassette includes a long wiping member, a feeding roller, a take-up roller, and a case. The long wiping member has a starting end and a terminating end at ends in a longitudinal direction and a wiping portion that is subjected to a tensile load at a position between the starting end and the terminating end. The long wiping member is wound from the terminating end in a roll. The feeding roller retains the long wiping member wound in a roll. The take-up roller is configured to take up the long wiping member from the starting end after the wiping portion wiped a liquid ejecting head that ejects liquid. The case rotatably retains the feeding roller and the take-up roller. The long wiping member has a weak portion having strength that does not withstand the tensile load at a position closer than the wiping portion to the terminating end.

A method of using a wiping member that solves the above-described problem is a method of using a long wiping member having a starting end and a terminating end at ends in a longitudinal direction, a wiping portion that is subjected to a tensile load at a position between the starting end and the terminating end, and a weak portion at a position closer than the wiping portion to the terminating end. The long wiping member is wound from the terminating end in a roll. The method includes rotating the long wiping member wound in a roll, after the wiping portion wiped a liquid ejecting head that ejects liquid, to allow the wiping portion to shift toward the terminating end, after the weak portion is exposed by the rotating, allowing the long wiping member to be separated by the tensile load at the weak portion into a portion adjacent to the starting end and a portion adjacent to the terminating end, and determining that the long wiping member is used up when the long wiping member is separated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus is described with reference to the drawings. The liquid ejecting apparatus is an inkjet printer configured to eject ink, which is one example of liquid, onto a medium such as a sheet of paper for printing.

Figure 1:
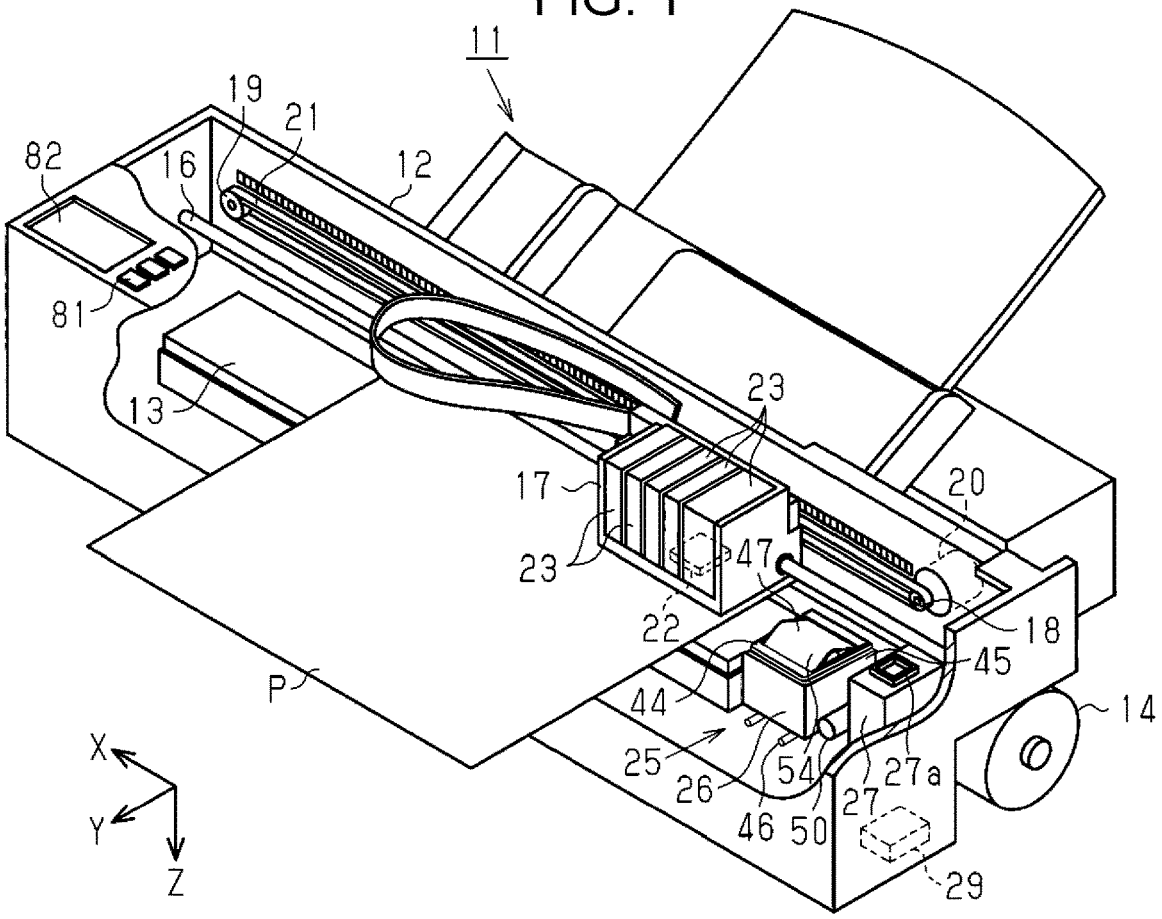
FIG. 1 is a perspective view illustrating an embodiment of a liquid ejecting apparatus and an embodiment of a wiper unit.

As illustrated in FIG. 1, a liquid ejecting apparatus 11 includes a housing 12, a supporting member 13 configured to support a medium P, a transport motor 14, a guide shaft 16, and a carriage 17 configured to move in a main scanning direction X along the guide shaft 16. The medium P is transported in a transport direction Y on the supporting member 13 by a transport roller (not illustrated) driven by the transport motor 14. The transport direction Y is a direction perpendicular to the main scanning direction X. An operation section 81 through which the liquid ejecting apparatus 11 is operated and a display 82 that displays an operational state or the like of the liquid ejecting apparatus 11 may be provided on an outer surface of the housing 12.

In the housing 12, the liquid ejecting apparatus 11 includes a driving pulley 18 and a driven pulley 19, which are rotatably supported at longitudinal ends, a timing belt 21, and a carriage motor 20. The timing belt 21 is wound around the driving pulley 18 and the driven pulley 19. The carriage 17 is connected to the timing belt 21.

The output shaft of the carriage motor 20 is connected to the driving pulley 18. The timing belt 21 is circulated around the driving pulley 18 and the driven pulley 19 in both directions by driving of the carriage motor 20 to reciprocate the carriage 17 along the guide shaft 16.

The liquid ejecting apparatus 11 includes a liquid ejecting head 22 fixed to the lower portion of the carriage 17. A plurality of ink cartridges 23 (five in this embodiment) each containing liquid is detachably attached to the upper portion of the carriage 17. During printing, the liquid ejecting head 22 ejects liquid onto the medium P on the supporting member 13 while the carriage 17 is being reciprocated. The ink cartridges 23 may be supported by the housing 12, instead of the carriage 17.

The plurality of (five) ink cartridges 23 contain ink of different colors, for example. For example, the colors may be cyan (C), magenta (M), yellow (Y), black (K), and white (W). The liquid ejecting apparatus 11 performs color printing by using the ink of different colors. The liquid ejecting apparatus 11 may perform primer printing by ejecting white ink onto a medium P in dark color over the entire printing region, and then may perform color printing on the primer, which is the white region.

The liquid ejecting head 22 may eject colors other than the four colors of CMYK and white (W). The colors may be light magenta, light cyan, light yellow, grey, and orange, for example. In addition, the number of colors ejected from the liquid ejecting head 22 may be four colors of CMYK, three colors of CMY, or one color of black, for example.

The ink may be a pigment ink in which a large number of pigment particles are dispersed within the liquid used as a dispersion medium. An organic pigment with an average particle diameter of 100 nm may be employed as a cyan pigment, a magenta pigment, or a yellow pigment, a carbon black (an inorganic pigment) with an average particle diameter of 120 nm may be employed as a black pigment, and a titanium oxide (an inorganic pigment) with an average particle diameter of 320 nm may be employed as a white pigment. The pigment ink may be an aqueous ink in which a large number of pigment particles are dispersed in water, used as the dispersion medium.

In the housing 12, the liquid ejecting apparatus 11 includes a maintenance unit 25 configured to perform maintenance of the liquid ejecting head 22 at the end adjacent to the starting point of the main scanning direction X. The maintenance unit 25 includes a wiper unit 26 and a capping unit 27 including a cap 27*a*.

The capping unit 27 includes a suction pump (not illustrated) configured to suction the inside of the cap 27*a*. When the liquid ejecting head 22 stops at a position facing the cap 27*a*, the cap 27*a* moves up to cover the liquid ejecting head 22. This is called "capping". The cap 27*a* in the capping state allows the inside of the liquid ejecting head 22 to be suctioned by driving of the suction pump. The suctioning removes foreign substances such as air bubbles in the liquid ejecting head 22. Such maintenance operation is called "suction cleaning".

The liquid ejecting head 22 may eject liquid to discharge liquid in nozzles 38. This is another maintenance operation called "flushing". The liquid ejected in the flushing may be received by the cap 27*a*.

The wiper unit 26 is configured to wipe the liquid on the liquid ejecting head 22 by using the wiping member 54. The maintenance operation to wipe the liquid ejecting head 22 by using the wiping member 54 is called "wiping". It is preferable that the wiping member 54 have a length in the main scanning direction X equal to that of the bottom surface of the liquid ejecting head 22.

The wiper unit 26 includes a wiper cassette 44 retaining the wiping member 54, a wiper holder 45 to which the wiper cassette 44 is attached, a guide rail 46 extending in the transport direction Y, and a wiping motor 50. A driving force of the wiping motor 50 is transmitted to the wiper holder 45 through a rack and pinion mechanism or a ball screw mechanism, which are not illustrated. The wiper holder 45 to which the wiper cassette 44 is attached reciprocates along the guide rail 46 when the wiping motor 50 is driven.

A wiping portion 47, which is a portion of the wiping member 54, protrudes from the wiper cassette 44. When the liquid ejecting head 22 stops at a position above the wiper cassette 44, the wiper cassette 44 moves in the transport direction Y with the wiper holder 45. Thus, the liquid ejecting head 22 is wiped by the wiping portion 47. The wiper cassette 44 is detached and attached to the wiper holder 45 to replace the used wiping member 54 with a new one.

The liquid ejecting apparatus 11 includes a controller 29 configured to control the components, such as the transport motor 14, the liquid ejecting head 22, and the maintenance unit 25. The controller 29 is configured to drive the transport motor 14 to feed the medium P. Furthermore, the controller 29 is configured to move the carriage 17 to the maintenance unit 25 and cause the maintenance unit 25 to perform necessary maintenance, such as wiping, flushing, and suction cleaning, when the controller 29 determines that the condition for execution of the maintenance is satisfied.

Figure 2:
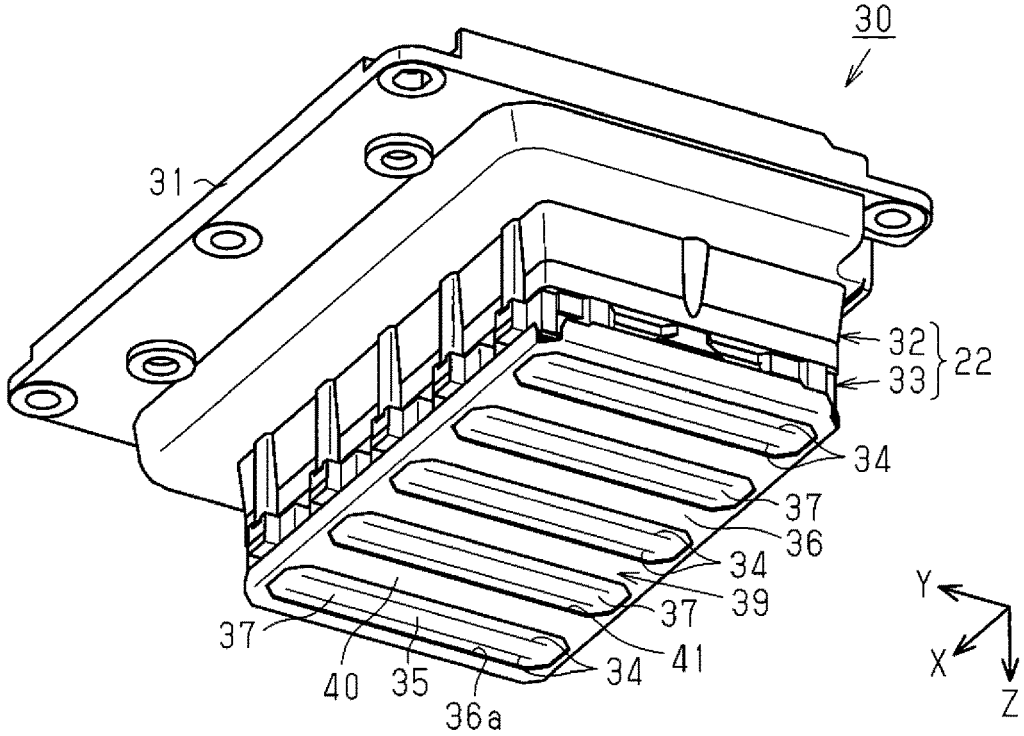
FIG. 2 is a perspective view of a head unit included in the liquid ejecting apparatus in FIG. 1.

As illustrated in FIG. 2, a head unit 30 includes a bracket 31 that enables the head unit 30 to be attached to the carriage 17 and the liquid ejecting head 22 protruding downward from the bracket 31. The head unit 30 is attached to a lower surface of the carriage 17. The liquid ejecting head 22 includes a passage formation portion 32 protruding downward from the bracket 31 and a head body 33 fixed to the lower surface of the passage formation portion 32.

The head body 33 has many nozzles 38 (see FIG. 3) in nozzle opening surfaces 35, which form a lower surface of the head body 33. The nozzles 38 arranged in the transport direction Y form a nozzle row 34. A plurality of (ten, for example) nozzle rows 34 are formed in the nozzle opening surfaces 35.

A planar cover member 36 having a plurality of (five, for example) through holes 36*a* is attached to the lower surface of the head body 33. The cover member 36 is formed of metal (stainless steel, for example), for example. A predetermined number of nozzle rows 34 (two rows, for example) is exposed through each of the through holes 36*a*. Regions of the nozzle opening surface 35 exposed through the through holes 36*a* are called "nozzle peripheral regions 37".

Figure 3:
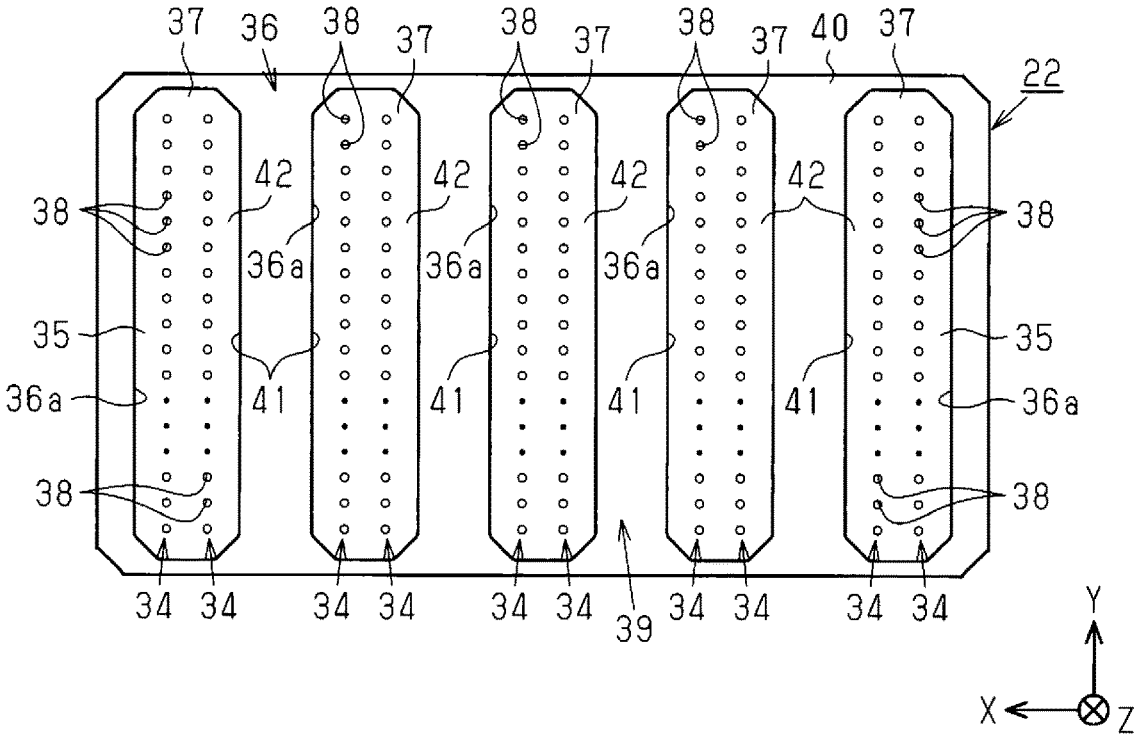
FIG. 3 is a bottom view of the head unit in FIG. 2.
Figure 4:
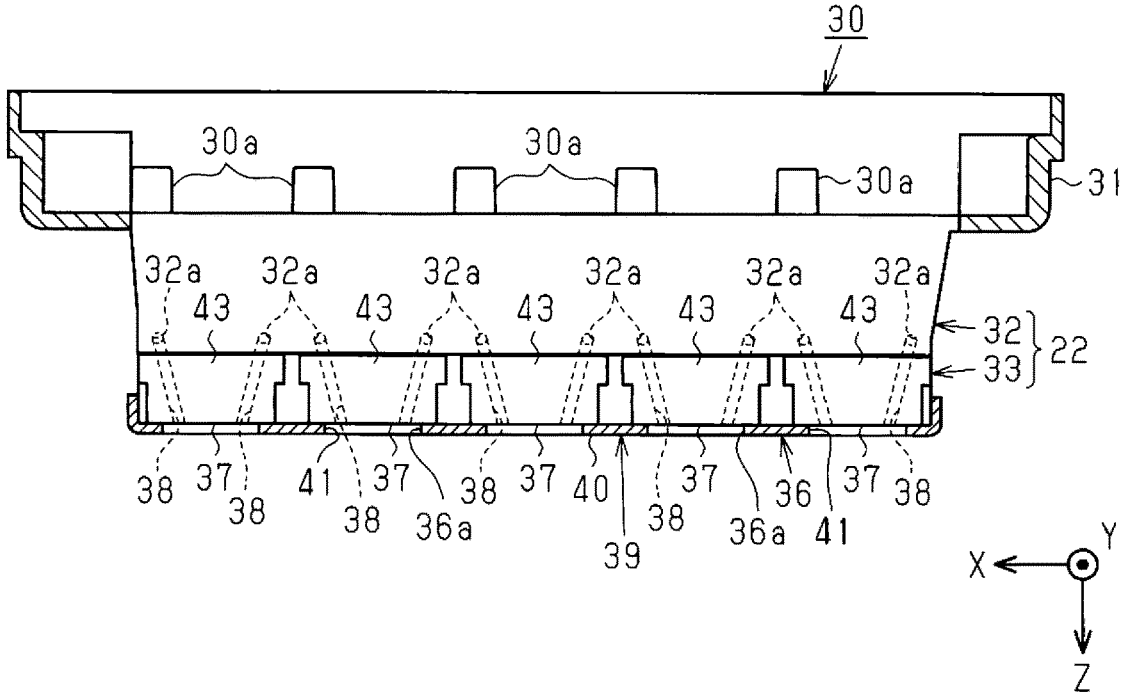
FIG. 4 is a cross-sectional view of the head unit in FIG. 2.

As illustrated in FIG. 3 and FIG. 4, the cover member 36 covers portions around the nozzle peripheral regions 37. The lower surface of the cover member 36 is called a protruded surface 40. The protruded surface 40 protrudes downward from the nozzle peripheral regions 37 by an amount corresponding to the thickness of the cover member 36. Thus, there are steps 41 between each of the nozzle peripheral regions 37 and the protruded surface 40. The entire bottom of the liquid ejecting head 22 including the protruded surface 40 and the nozzle peripheral regions 37 is called a nozzle surface 39. The entire nozzle surface 39 is a target to be wiped.

It is preferable that a liquid-repellent treatment be performed on the nozzle opening surface 35 to repel the ejected liquid. The liquid-repellent treatment forms a liquid-repellent film 42 on the nozzle opening surfaces 35. The liquid-repellent film 42 may be a liquid-repellent coating film or a liquid-repellent monomolecular film. The thickness of the liquid-repellent film 42 and the method of liquid-repellent treatment may be suitably determined.

The composition and components of the liquid-repellent film 42 may be changed depending on the liquid to be ejected. For example, the liquid-repellent film 42 that repels a water-based ink includes a thin film foundation layer including polyorganosiloxane having an alkyl group, as a main component, and a liquid-repellent film layer including a metal alkoxide having a fluorine-containing long-chain polymer group.

The liquid-repellent film 42 may be gradually worn away due to repeated wiping and the liquid repellency thereof gradually decreases as the liquid-repellent film 42 is worn away. The decrease in the liquid repellency of the liquid repellence film 42 makes a wetting angle (contact angle) of the liquid in relation to the nozzle peripheral region 37 smaller. Thus, when liquid droplets in the form of mist are applied to the nozzle peripheral region 37, the liquid droplets are likely to spread and become one large liquid droplet. The large liquid droplet may block the opening of the nozzle 38 or may flow into the nozzle 38.

When liquid droplets are ejected through the nozzle 38 with liquid being present around the opening of the nozzle 38, the flying direction of the ejected liquid droplets may be curved. Such curve in the flying direction of the liquid droplets causes the liquid droplets to land at a displaced landing position (print dot formation position), leading to lower printing quality. Thus, it is unfavorable that the liquid-repellent film 42 is worn by wiping.

The surface of the cover member 36 is not subjected to liquid-repellent treatment. Thus, the protruded surface 40 has lower liquid repellency than the nozzle peripheral regions 37. Thus, a wetting angle (contact angle) of the liquid in relation to the protruded surface 40 is smaller than that of the liquid in relation to the nozzle peripheral regions 37.

As illustrated in FIG. 4, the liquid ejecting head 22 includes a plurality of (five in this embodiment) recording heads 43 (unit heads) arranged side by side at a regular interval in the main scanning direction X. The cover member 36 covers portions around the nozzle opening surfaces 35, which are the lower surfaces of the recording heads 43. The nozzle peripheral regions 37 each including two rows of the nozzles 38 are exposed through the through holes 36*a*.

The nozzles 38 constituting the nozzle row 34 (see FIG. 3) are in communication with passages 32*a* extending in the passage formation portion 32. The passages 32*a* provided for the respective colors of ink are in communication with supply tube portions 30*a* extending upward from the upper surface of the passage formation portion 32. The supply tube portions 30*a* are in communication with the ink cartridges 23 (see FIG. 1) attached to the carriage 17. Liquid is supplied to the nozzles 38 in the recording heads 43 from the corresponding ink cartridges 23 through the supply tube portions 30*a* and the passages 32*a*.

Figure 5:
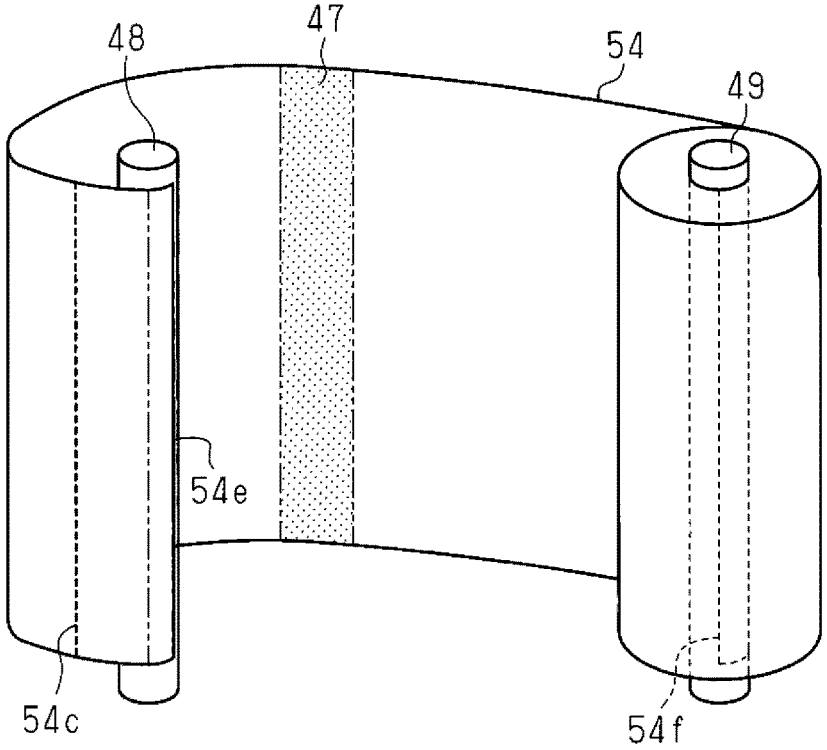
FIG. 5 is a perspective view illustrating an embodiment of a wiping member.

Next, the structure of the wiping member 54 is described in detail. As illustrated in FIG. 5, the wiping member 54 is a long liquid absorbing member having a starting end 54*f* and a terminating end 54*e*, which are ends in the longitudinal direction. The wiping member 54 is wound around a core 48 from the terminating end 54*e* in a roll. The portion of the wiping member 54 around the terminating end 54*e* may be attached to the core 48. The wiping member 54 has a weak portion 54*c*, which has a lower tensile strength than the other portions of the wiping member 54, at a position near the terminating end 54*e* attached to the core 48.

The weak portion 54*c* is a dotted cut line extending in the width direction of the wiping member 54, for example. The wiping member 54 is wound around the core 48 such that the other portions of the wiping member 54 are overlapped on the weak portion 54. The wiping member 54 wound around the core 48 is unwound from the starting end 54*f* and used. The weak portion 54*c* is exposed when a large part of the wiping member 54 is unwound from the core 48.

The wiping member 54 may be fixed to the take-up core 49 at the portion adjacent to the starting end 54*f*. This allows the unwound portion of the wiping member 54 to be wound around the take-up core 49 and the portion of the wiping member 54 wound around the core 48 to be unwound by the rotation of the take-up core 49 at the same time.

A portion of the wiping member 54 unwound from the core 48 and subjected to a tensile load at a position between the starting end 54*f* and the terminating end 54*e* includes a wiping portion 47. The wiping portion 47 gradually shifts from the portion of the wiping member 54 adjacent to the starting end 54*f* to the portion adjacent to the terminating end 54*e* by the rotation of the take-up core 49. The weak portion 54*c* is located closer than the wiping portion 47 to the terminating end 54*e* and has strength that does not withstand a predetermined tensile load applied to the wiping portion 47.

Next, the structure of the wiper cassette 44 is described in detail. The wiper cassette 44 includes the roll wiping member 54, a feeding roller 53 retaining the roll wiping member 54, a take-up roller 55 retaining the take-up core 49, and a case 52 rotatably retaining the feeding roller 53 and the take-up roller 55. The case 52 has an opening 51 in the upper surface. The wiping portion 47 protrudes upward from the case 52 through the opening 51.

The feeding roller 53 may be disposed at the middle portion of the bottom of the case 52 with its axis extending in the main scanning direction X. The take-up roller 55 may be disposed in the case 52 at a position away from the feeding roller 53 in the transport direction Y. In the case 52, the transport route of the wiping member 54 extends from the feeding roller 53 located at the upstream side to the take-up roller 55 located at the downstream side. The wiper cassette 44 or the wiper unit 26 includes a take-up motor 56 configured to rotate the take-up roller 55.

The wiper cassette 44 includes a first roller 57, a second roller 58, a third roller 59, a fourth roller 60, and a driven roller 61, which are rotatably supported by the case 52. The first roller 57, the second roller 58, the third roller 59, and the fourth roller 60 are arranged in this order along the transport route of the wiping member 54 from the side adjacent to the feeding roller 53 toward the take-up roller 55 with distances therebetween.

The driven roller 61 faces the second roller 58 with the wiping member 54 therebetween. The driven roller 61 may face the other roller than the second roller 58, preferably face the roller located between the feeding roller 53 and the third roller 59.

The third roller 59 and the fourth roller 60 are arranged at ends of the opening 51 in the transport direction Y. The second roller 58 is located below the third roller 59. The first roller 57 is located below the second roller 58. The feeding roller 53 and the first roller 57 are arranged side by side in the transport direction Y. The take-up roller 55 is located below the fourth roller 60.

The surface of the wiping member 54 to be in contact with the nozzle surface 39 is a front surface and the surface opposite the front surface is a rear surface. The rollers 57, 59, 60, and 61 are in contact with the rear surface of the wiping member 54. The second roller 58 is in contact with the front surface of the wiping member 54.

When the take-up roller 55 is rotated by driving of the take-up roller 56, the wiping member 54 on the transport route is wound up by the take-up roller 55. At the same time, the wiping member 54 is unwound from the feeding roller 53 toward the transport route and guided by the rollers 57 to 61. The rollers 55, 57 to 61 and the take-up motor 56 function as a transport mechanism of the wiping member 54.

The wiper cassette 44 includes a pressing mechanism 69 configured to apply a tensile load to the wiping member 54. The pressing mechanism 69 includes a pressing roller 70, a supporting shaft 71 rotatably supporting the pressing roller 70, and a spring 72 that presses the supporting shaft 71 outwardly from the opening 51. The pressing roller 70 is disposed between the third roller 59 and the fourth roller 60. The wiping member 54 is pressed by the pressing roller 70 on the rear surface. The pressed portion protrudes to the outside of the case 52 through the opening 51. A portion of the wiping member 54 wound around the pressing roller 70 is the wiping portion 47.

It is preferable that the wiper cassette 44 include a load sensing mechanism 62 configured to detect the tensile load applied to the wiping member 54. The load sensing mechanism 62 includes a detection roller 64, a body 63 rotatably retaining the detection roller 64, and a spring 65 pressing the detection roller 64 with the body 63 therebetween. The detection roller 64 is in contact with the rear surface of the wiping member 54 at a position between the first roller 57 and the second roller 58. The axes of the rollers 53, 55, 57 to 61, 64, and 70 are parallel to each other.

The load sensing mechanism 62 includes a flag 66 held by the body 63 and a contact sensor 67 located on the opposite side of the body 63 from the detection roller 64. The contact sensor 67 is electrically connected to the controller 29 (see FIG. 1). When the flag 66 comes in contact with the contact sensor 67, the contact sensor 67 sends a detection signal to the controller 29.

When the contact sensor 67 is in contact with the flag 66, "the contact sensor 67 is turned ON". When the contact sensor 67, which has been in contact with the flag 67, is moved away from the flag 66, "the contact sensor 67 is turned OFF". The contact sensor 67 stops sending the detection signal when the flag 66 is moved away from the contact sensor 67.

Figure 6:
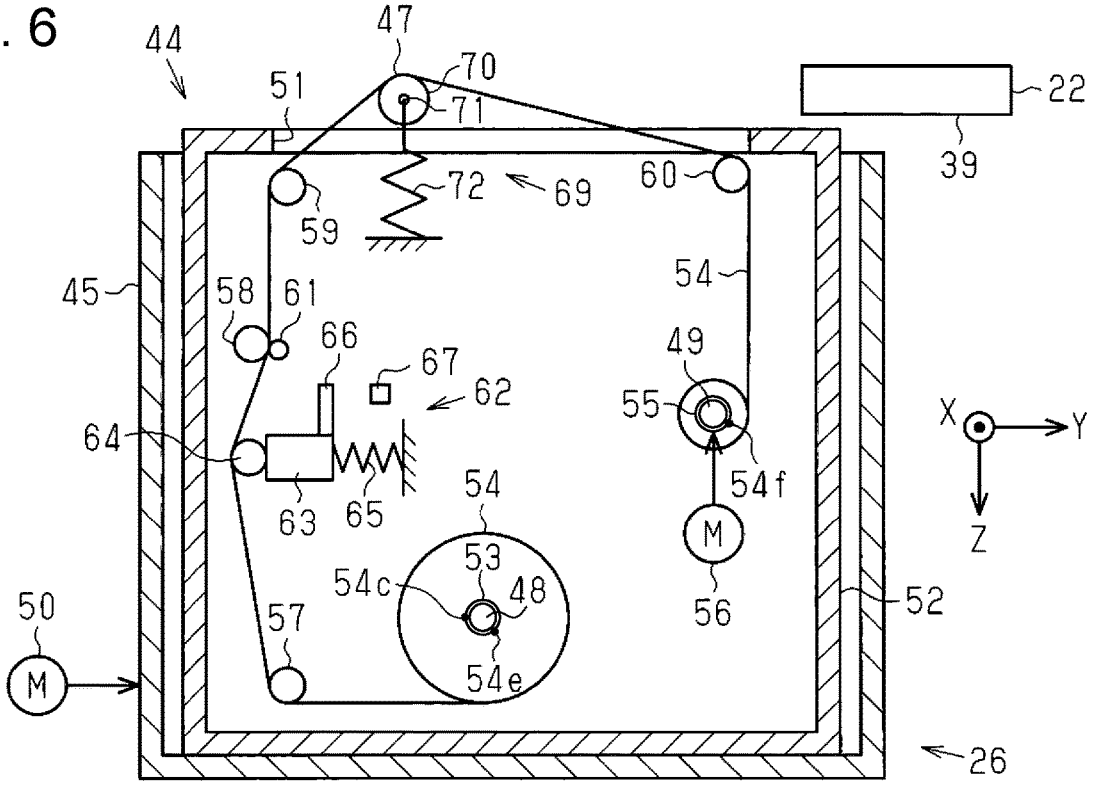
FIG. 6 is a cross-sectional view illustrating an embodiment of a wiper cassette.

The tensile load applied to the wiping member 54 during normal use of the wiper cassette 44, which is illustrated in FIG. 6, is a first reference value N1. The first reference value N1 is a tensile load required to stretch the wiping member 54 between the third roller 59 and the fourth roller 60. The flag portion 66 comes in contact with the contact sensor 67 when the tensile load applied to the wiping member 54 exceeds a second reference value N2 that is larger than the first reference value N1 (N2>N1).

Next, operation of the wiper unit 26 at the time of wiping is described. Before wiping, the wiper holder 45 to which the wiper cassette 44 is attached is moved to a standby position (indicated in FIG. 6) located upstream of the liquid ejecting head 22 in the transport direction Y.

When the wiper cassette 44 is moved in the transport direction Y, the wiping portion 47 comes in contact with the liquid ejecting head 22. At this time, the liquid ejecting head 22 pushes the pressing roller 70 against a biasing force of the spring 72 with the wiping portion 47 therebetween. Thus, the pressing roller 70 is pushed down, and a large part of the pressing roller 70 is located in the case 52 (a state illustrated in FIG. 7).

Figure 7:
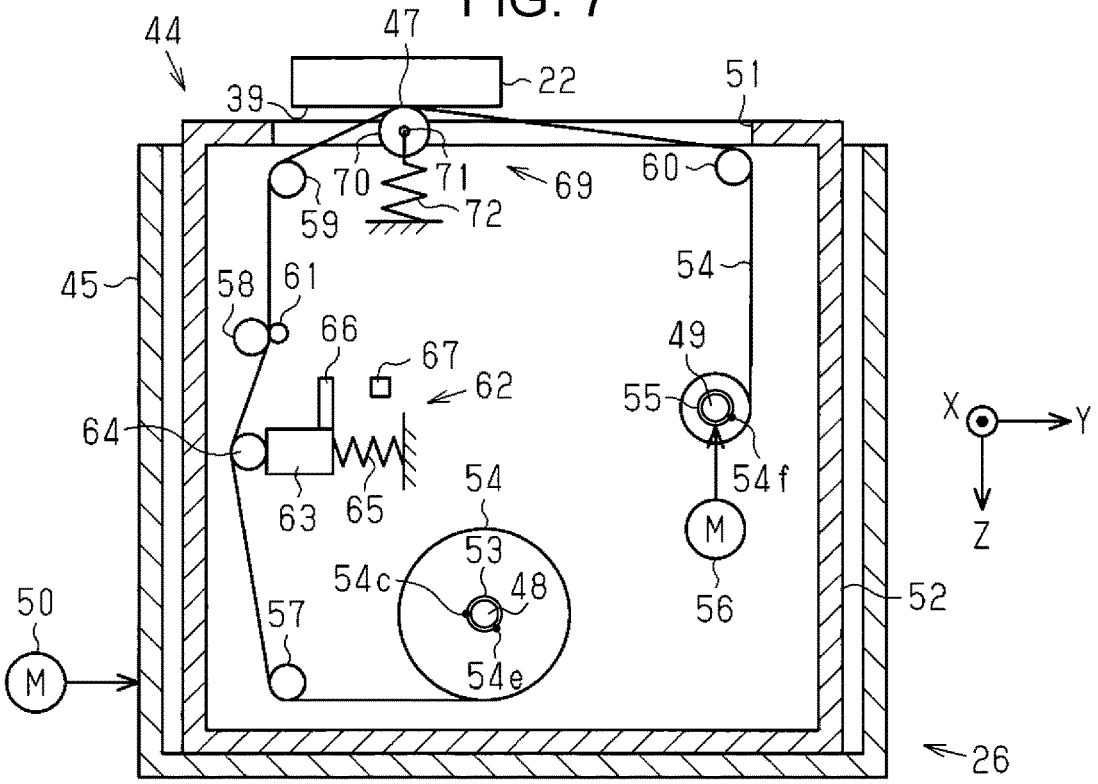
FIG. 7 is a cross-sectional view illustrating the wiper cassette in FIG. 6 wiping the liquid ejecting head.

As illustrated in FIG. 7, the pressing roller 70 that has pushed down receives the biasing force of the spring 72 and presses the wiping portion 47 against the nozzle surface 39. When the wiper cassette 44 in this state moves in the transport direction Y, the wiping portion 47 wipes the nozzle surface 39 while absorbing the liquid on the liquid ejecting head 22.

Figure 8:
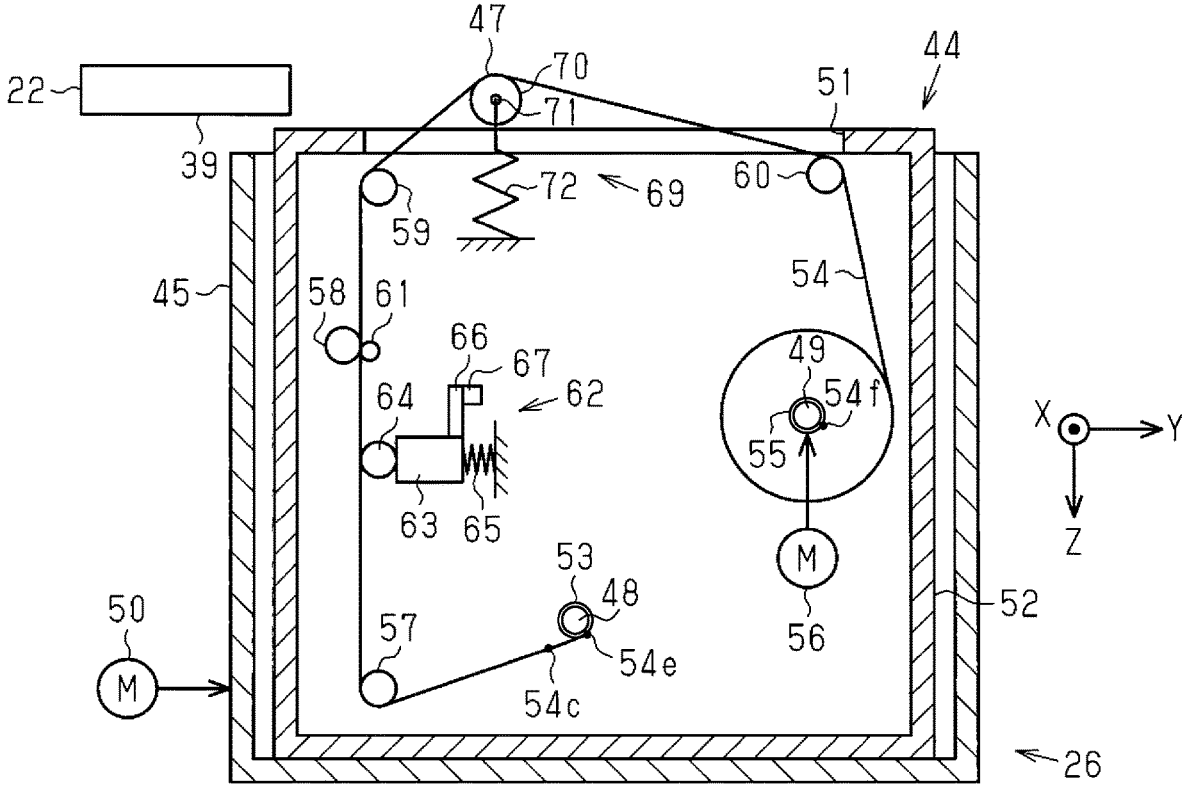
FIG. 8 is a cross-sectional view illustrating the wiper cassette in FIG. 7 with an exposed weak portion.

As illustrated in FIG. 8, when the wiper cassette 44 is moved and the wiping portion 47 is located away from the liquid ejecting head 22, the wiping with the wiping member 54 ends. When the wiping portion 47 is moved away from the liquid ejecting head 22, the pressing roller 70 returns to the default position (indicated in FIG. 6) by the biasing force of the spring 72. After the wiping, the wiper cassette 44 moves in an opposite direction in the transport direction Y to the standby position.

Figure 9:
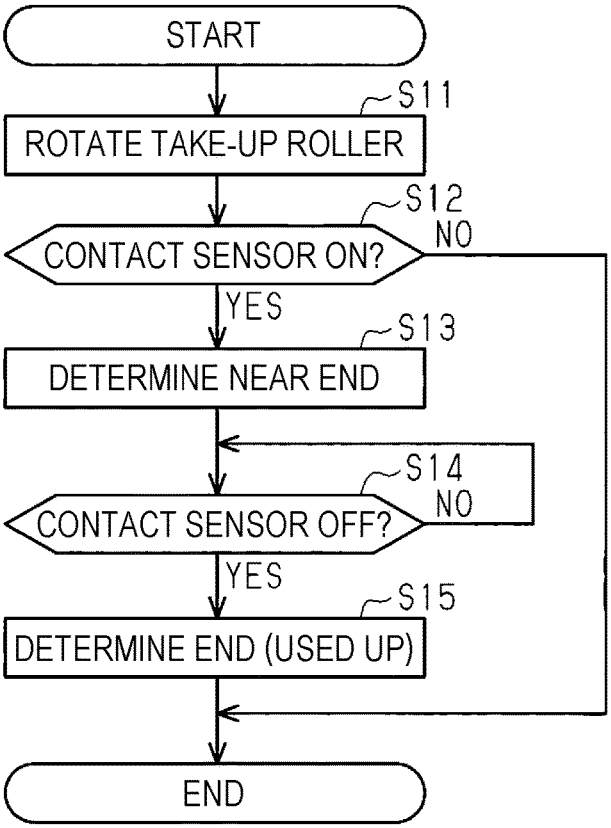
FIG. 9 is a flow chart indicating processing performed by a controller after wiping of the liquid ejecting head.

Next, the processing performed by the controller 29 after the liquid ejecting head 22 is wiped by the wiping portion 47 is described. As indicated in FIG. 9, at step S11, the controller 29 drives the take-up motor 56 such that the take-up roller 55 rotates a predetermined amount. It is preferable that the rotation amount correspond to an amount of the used wiping portion 47, which has absorbed liquid through wiping, to be replaced with an unused portion of the wiping member 54. In this rotation, the roll wiping member 54 rotates together with the feeding roller 53, so that the wiping portion 47 in contact with the pressing roller 70 shifts toward the terminating end 54*e*.

Next, at step S12, the controller 29 determines whether the contact sensor 67 sent a detection signal or not. If the contact sensor 67 did not send a detection signal, the controller 29 terminates the processing.

After the repeated rotation of the take-up roller 55 by the predetermined amount, the wiping member 54 wound around the core 48 has little unused portion left and the weak portion 54*c* is exposed. In this state, the wiping member 54 is not fed from the feeding roller 53 when the take-up roller 55 is rotated.

As illustrated in FIG. 8, this gradually makes the wiping member 54, which is pressed and bent by the detection roller 64, straight between the first roller 57 and the second roller 58. In this process, the tensile load applied to the wiping member 54 gradually increases. The wiping member 54, which is gradually made straight, pushes the detection roller 64 against a biasing force of the spring 65. This moves the flag 66 together with the body 63.

When the tensile load applied to the wiping member 54 exceeds the second reference value N2, the flag 66 comes in contact with the contact sensor 67 and the contact sensor 67 sends a detection signal. In other words, the contact sensor 67 is turned ON. This satisfies the condition of step S12, and the controller 29 proceeds to step S13. The contact sensor 67 keeps sending the detection signal while the flag 66 is in contact with the contact sensor 67.

At step S13, the controller 29 determines that the wiping member 54 is used up soon (near the end). In this case, the controller 29 may inform the user that the wiping member 54 is used up soon by displaying the information on the display 82, for example.

At step S14, which comes after step S13, it is determined whether the contact sensor 67 has stopped sending the detection signal. If the contact sensor 67 keeps sending the detection signal, i.e., the condition of step S14 is not satisfied, the controller 29 repeats step S14.

After the flag 66 comes in contact with the contact sensor 67, the take-up roller 55 may further rotate such that the tensile load exceeds a third reference value N3, which is larger than the second reference value N2 (N3>N2). In such a case, the wiping member 54 is separated at the weak portion 54*c* into a portion adjacent to the starting end 54*f* and a portion adjacent to the terminating end 54*e*. The third reference value N3 is a value of the tensile load that exceeds the strength of the weak portion 54*c*. When the wiping member 54 is separated, the portion of the wiping member 54 adjacent to the starting end 54*f* is transported by the rotation of the take-up roller 55 along the transport route, and the portion of the wiping member 54 adjacent to the terminating end 54*e* remains connected to the take-up core 49.

As illustrated in FIG. 8, it is preferable that the weak portion 54*c* be positioned between the pressing roller 70 and the feeding roller 53 when the large portion of the wiping member 54 is unwound from the core 48. If the rollers 58 and 61 that sandwich the wiping member 54 are located between the pressing roller 70 and the feeding roller 53, it is more preferable that the weak portion 54*c* be positioned between the rollers 58, 61 and the feeding roller 53.

The detection roller 64 is not pressed by the wiping member 54 when the wiping member 54 is separated, and the detection roller 64 moves together with the body 63 and the flag 66 by a biasing force of the spring 65. At this time, the tensile load applied to the wiping member 54 located between the rollers 58, 61 and the feeding roller 53 is smaller than the first reference value N1. The flag 66 moves away from the contact sensor 67 as the detection roller 64 moves. Thus, the contact sensor 67 stops sending the detection signal, and the condition of step S14 is satisfied. When the condition of step S14 is satisfied, the controller 29 proceeds to step S15.

As described above, when that state of the contact sensor 67 is switched from ON to OFF, the load sensing mechanism 62 determines that the tensile load applied to the wiping member 54 is smaller than the first reference value N1.

At step S15, the controller 29 determines that there is no the wiping member 54 left, i.e., the wiping member 54 is used up (end), and the controller 29 terminates the processing. In other words, when the wiping member 54 is separated at the weak portion 54*c* into the portion adjacent to the starting end 54*f* and the portion adjacent to the terminating end 54*e* and the load sensing mechanism 62 determines that the tensile load is smaller than the first reference value N1, the controller 29 determines that the wiping member 54 is used up. In this case, the controller 29 may inform the user that there is no wiping member 54 left or that the wiper cassette 44 needs replacement by displaying the information on the display 82, for example.

When the wiping member 54 is determined to be used up, the controller 29 may prohibit subsequent wiping. Furthermore, when the wiping member 54 is determined to be used up, the controller 29 may inform the user that the wiper cassette 44 needs replacement after all the wiping member 54 continuous with the starting end 54*f* is taken up around the take-up core 49 by rotation of the take-up roller 55.

Next, operation of the embodiment is described. The wiping member 54 is gradually unwound by the rotation of the rollers 53 and 55, and the weak portion 54*c* is finally exposed. Then, the wiping member 54 is separated at the weak portion 54*c* by the tensile load generated by the rotation of the take-up roller 55. Thus, the transport mechanism of the wiping member 54 is not subjected to an excessive load that may be generated when the take-up roller 55 is rotated while the feeding roller 53 is not rotated.

When the wiping member 54 is separated at the weak portion 54*c*, the wiping member 54 actually does not have an unused portion. Thus, the controller 29 is able to correctly determine when the wiping member 54 is used up based on the separation of the wiping member 54.

The following advantages are obtained by the above-described embodiment.

(1) When the wiping member 54 is unwound from the core 48 and the weak portion 54*c* is exposed, the wiping member 54 is separated by the tensile load at the weak portion 54*c* into the portion adjacent to the starting end 54*f* and the portion adjacent to the terminating end 54*e*. The separation enables correct determination on when the wiping member 54 is used up. The used wiping member 54 may be replaced with a new one based on the determination. This allows the liquid ejecting head 22 to be reliably wiped.

(2) The wiping member 54 is able to be separated along the cut line that forms the weak portion 54*c* when the wiping member 54 receives the tensile load.

(3) When the wiping member 54 is used up, a new wiping member 54 is able to be supplied by replacement of the wiping cassette 44.

(4) The new wiping member 54 is able to be supplied by replacement of the wiper cassette 44, and the wiper holder 45 is able to be kept used without replacement.

(5) The controller 29 is able to perform a proper subsequent process based on the determination that the wiping member 54 is used up.

(6) The wiping member 54 that has been separated at the weak portion 54*c* does not resist the tensile load. Thus, the controller 29 is able to determine that the wiping member 54 is separated based on that the tensile load detected by the load sensing mechanism 62 is smaller than the reference value.

Modifications

The above embodiment may be modified as per the modifications below. The configurations in the above embodiment may be used in any combination with the configurations in the modifications below. The configurations in the modifications below may be used in any combination.

Figure 10:
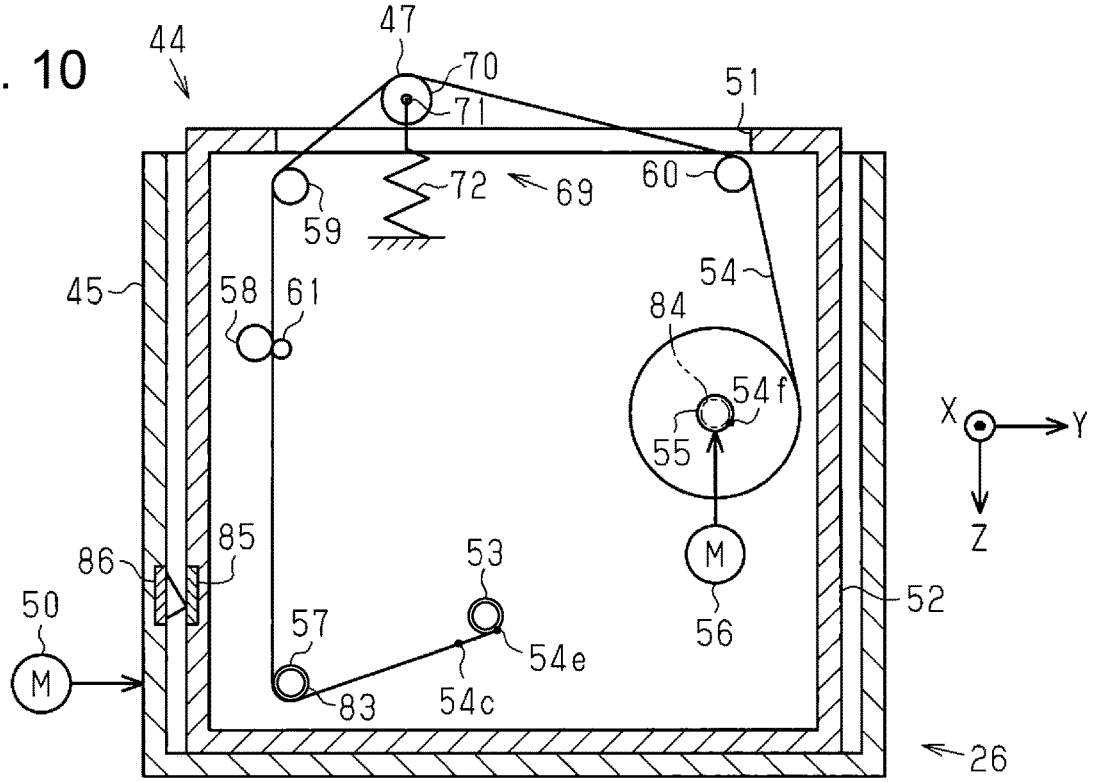
FIG. 10 is a cross-sectional view illustrating a modification of the wiper cassette.

As illustrated in FIG. 10, the wiper cassette 44 or the wiper unit 26 may include a rotation sensing mechanism 83 configured to detect the rotation of the feeding roller 53, instead of the load sensing mechanism 62. The rotation sensing mechanism 83 may be configured to detect rotation of any one of the rollers 53, 57 to 61, and 70, except for the take-up roller 55.

In this configuration, the take-up roller 55 may be rotated after the wiping member 54 has little unused portion left and the exposed weak portion 54*c*. In such a case, the wiping member 54 is separated at the weak portion 54*c* by rotation of the take-up roller 55 when the tensile load applied to the wiping member 54 exceeds the reference value. Thus, the feeding roller 53 is not rotated by the rotation of the take-up roller 55.

Thus, the controller 29 may determine that the wiping member 54 is used up when the rotation sensing mechanism 83 has stopped detecting the rotation of the feeding roller 53 while the take-up roller 55 is rotating to take up the wiping member 54. As described above, the controller 29 is able to determine that the wiping member 54 is separated based on that the rotation sensing mechanism 83 has stopped detecting the rotation of the feeding roller 53.

As illustrated in FIG. 10, the wiping member 54 may be fixed to the feeding roller 53 and the take-up roller 55 at the starting end 54*e* and the terminating end 54*f*, respectively. In such a case, the core 48 and the take-up core 49 are not required for winding the wiping member 54 in a roll.

As illustrated in FIG. 10, the wiper cassette 44 or the wiper unit 26 may include a rotation amount detection mechanism 84 configured to detect the rotation of the take-up roller 55. The rotation amount detection mechanism 84 may be a rotary encoder. In such a case, when the cumulative total amount of rotation of the take-up roller 55 detected by the rotation amount detection mechanism 84 exceeds a preset value, the controller 29 may determine that the wiping member 54 is used up (end).

The cumulative total amount detected by the rotation amount detection mechanism 84 may be larger than the actual amount of the wiping member 54 taken up. In such a case, it may be determined that the wiping member 54 is used up although the wiping member 54 has an unused portion left. Conversely, the cumulative total amount detected by the rotation amount detection mechanism 84 may be smaller than the actual amount of the wiping member 54 taken up. In such a case, the take-up roller 55 may keep rotating although the wiping member 54 has been used up. In this case, the weak portion 54*c* does not withstand the tensile load generated by the rotation of the take-up roller 55, and the wiping member 54 is separated at the weak portion 54*c*. Thus, an excessive load is unlikely to be applied to the transport mechanism of the wiping member 54.

As illustrated in FIG. 10, the wiper cassette 44 may include a recording medium 85 that records the amount of rotation of the take-up roller 55 as a used amount of the wiping member 54. The recording medium 85 may be an IC chip. In such a case, the wiper holder 45 may include a connector 86 that reads out the information in the recording medium 85 (the used amount of the wiping member 54) and writes the information in the recording medium 85, when the wiper cassette 44 is attached. This configuration enables the user to know the amount of the wiping member 54 left when the in-use wiper cassette 44 is detached from the wiper holder 45 and attached to another wiper holder 45.

The weak portion 54*c* may be a belt-like thin portion extending in the width direction of the wiping member 54 and having a smaller thickness than the other portions of the wiping member 54 including the wiping portion 47. The wiping member 54 may be formed of a plurality of sheets overlapped each other. In such a case, the number of sheets overlapped at the weak portion 54*c* is reduced to form the weak portion 54*c* having a smaller thickness than the other portions. Alternatively, pieces of the wiping member 54 may be connected by an intermediate sheet having a smaller thickness than the wiping member 54. The intermediate sheet forms the thin weak portion 54*c*. Such configurations enable the wiping member 54 to be separated at the thin weak portion 54*c* when the tensile load is applied to the wiping member 54.

The fixation strength of the terminating end 54*e* to the core 48 may be lowered such that the terminating end 54*e* of the wiping member 54 is detached from the core 48 (if the core 48 does not exist, from the feeding roller 53) when the tensile load applied to the wiping member 54 exceeds the reference value. For example, the adhesion strength may be lowered such that the wiping member 54 is detached from the core 48 by the tensile load. Alternatively, a member (such as a clip) may connect the terminating end 54*e* of the wiping member 54 to the core 48. In such a case, the connection is cancelled by the tensile load. Alternatively, the terminating end 54*e* of the wiping member 54 may be fixed to the core 48 through an adhesive sheet having a lower strength than the wiping member 54. In such a case, the adhesive sheet is torn by application of the tensile load, and thus the wiping member 54 is detached from the core 48.

Figure 11:
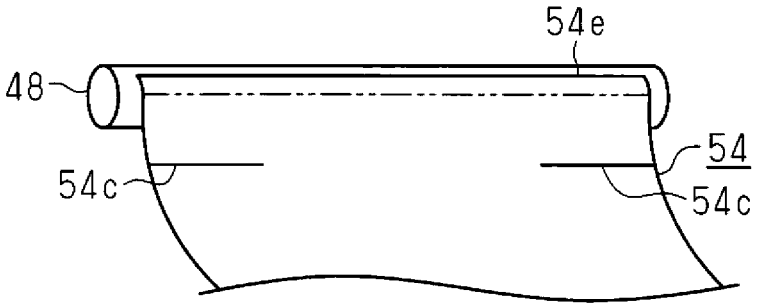
FIG. 11 is a perspective view illustrating a first modification of the weak portion of the wiping member.
Figure 12:
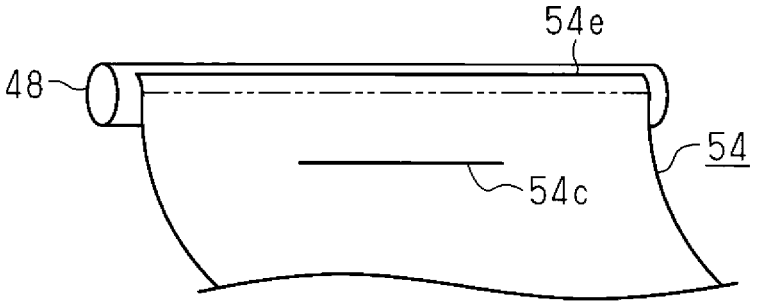
FIG. 12 is a perspective view illustrating a second modification of the weak portion of the wiping member.

A wiping member 54 of a first modification illustrated in FIG. 11 has cut lines, which form the weak portions 54*c*, at the both end portions in the width direction, except for the middle portion. A wiping member 54 of a second modification illustrated in FIG. 12 has a cut line, which forms the weak portion 54*c*, at the middle portion, except for the end portions in the width direction.

Figure 13:
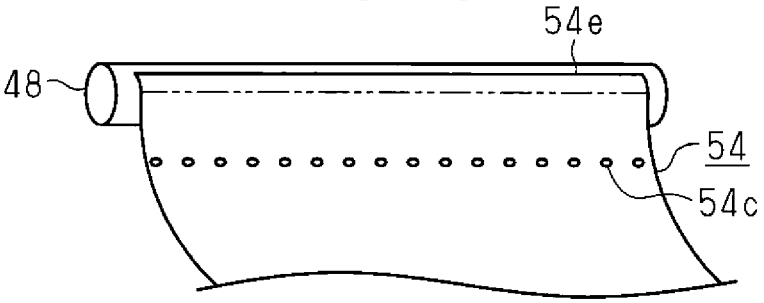
FIG. 13 is a perspective view illustrating a third modification of the weak portion of the wiping member.

A wiping member 54 of a third modification illustrated in FIG. 13 has the weak portion 54*c* composed of multiple holes arranged in the width direction with a predetermined distance therebetween. The weak portion 54*c* may be a cut line extending across one surface of the wiping member 54 in the width direction. The cut line in this case does not penetrate the wiping member 54 and is a cut only on one surface.

The liquid ejected from the liquid ejecting head 22 for flushing may be received by the used portion (the portion that has wiped the nozzle surface 39) of the wiping member 54. The pressing roller 70 of the pressing mechanism 69 may be rotated by a driving source, such as a motor.

During the wiping of the nozzle surface 39 by the wiper unit 26, the liquid ejecting head 22 may be moved while the wiper unit 26 stops. Alternatively, the liquid ejecting head 22 and the wiper cassette 44 may be both moved to wipe the nozzle surface 39.

The liquid ejecting apparatus 11 may include a mechanism for performing treatment to fix the ink, which has been attached to the medium P, onto the medium P. In this case, such a treatment may be performed on the wiping portion 47 to which the ink is attached by the wiping. The treatment may be UV application for curing the UV ink or ejection or application of treatment liquid for curing ink. The used wiping portion 47 subjected to such treatment allows the user who changes the wiper cassette 44 to get less dirt on his/her hand.

The liquid ejecting apparatus 11 may be a line head type liquid ejecting apparatus that does not include the carriage 17 supporting the liquid ejecting head 22 and includes a line head whose printable area extends over the entire width of the medium P. The wiper cassette 44 may be moved to wipe the liquid ejecting head 22 if the line head does not move.

The liquid ejected from the liquid ejecting head 22 is not limited to ink and may be a liquid state material including particles of functional material dispersed or mixed in liquid. For example, the liquid ejecting head 22 may eject a liquid state material including a dispersed or dissolved electrode material or color material (pixel material), which are commonly used in the production of a liquid crystal display, an electro luminescence (EL) display, and a surface emitting display.

The medium P is not limited to a sheet of paper and may be a plastic film or a thin plate, for example, or may be a fabric used in a fabric printing apparatus. The medium P may be a cloth having any shape, such as a T shirt, or may be a three-dimensional object having any shape, such as a dish and a stationery.

The entire disclosure of Japanese Patent Application No. 2017-121401, filed Jun. 21, 2017 is expressly incorporated by reference herein.

What is claimed is:

1. A roll wiping member unit comprising:

a long wiping member having a starting end and a terminating end at ends in a longitudinal direction and a wiping portion that is subjected to a tensile load at a position between the starting end and the terminating end, the long wiping member being configured to wipe a liquid ejecting head that ejects liquid at the wiping portion; and a core on which the long wiping member being wound from the terminating end in a roll, wherein the long wiping member has a single weak portion having strength that does not withstand the tensile load at a position closer than the wiping portion to the terminating end, wherein the single weak portion is configured to separate when the tensile load exceeds a threshold.

2. The roll wiping member unit according to claim 1, wherein the weak portion is a dotted cut line extending in a width direction of the long wiping member.

3. The roll wiping member unit according to claim 1, wherein the weak portion is thinner than the other portions including the wiping portion.

4. A wiper cassette comprising:

a long wiping member having a starting end and a terminating end at ends in a longitudinal direction and a wiping portion that is subjected to a tensile load at a position between the starting end and the terminating end, the long wiping member being wound from the terminating end in a roll;

a feeding roller retaining the long wiping member;

a take-up roller configured to take up the long wiping member from the starting end after the wiping portion wiped a liquid ejecting head that ejects liquid;

a pressing portion pressing the wiping portion toward the liquid ejecting head on a transport route of the wiping member extending from the feeding roller to the take-up roller; and a case rotatably retaining the feeding roller and the take-up roller, the case retaining the pressing portion, and wherein the long wiping member has a single weak portion configured to be separated when the tensile load exceeds a threshold, and the single weak portion is located at a position between the feeding roller and the pressing portion on the transport route when the single weak portion is exposed.

5. The wiper cassette according to claim 4, further comprising:

a pair of rollers configured to sandwich the long wiping member, the pair of rollers being located between the feeding roller and the pressing portion on the transport route, and the weak portion is located at a position between the feeding roller and the pair of rollers on the transport route when the weak portion is exposed.

6. A wiper unit comprising:

a wiper cassette; and a wiper holder to which the wiper cassette is attached, wherein the wiper cassette includes:

a long wiping member having a starting end and a terminating end at ends in a longitudinal direction and a wiping portion that is subjected to a tensile load at a position between the starting end and the terminating end, the long wiping member being wound from the terminating end in a roll;

a feeding roller retaining the long wiping member;

a take-up roller configured to take up the long wiping member from the starting end after the wiping portion wiped a liquid ejecting head that ejects liquid;

a pressing portion pressing the wiping portion toward the liquid ejecting head on a transport route of the wiping member extending from the feeding roller to the take-up roller; and a case rotatably retaining the feeding roller and the take-up roller, the case retaining the pressing portion, and wherein the long wiping member has a single weak portion configured to be separated when the tensile load exceeds a threshold, and the single weak portion is located at a position between the feeding roller and the pressing portion on the transport route when the single weak portion is exposed.

7. The wiper unit according to claim 6, wherein the wiper cassette further includes a pair of rollers configured to sandwich the long wiping member and are located between the feeding roller and the pressing portion on the transport route, and the weak portion is located at a position between the feeding roller and the pair of rollers on the transport route when the weak portion is exposed.

8. A liquid ejecting apparatus comprising:

a liquid ejecting head configured to eject liquid; and a wiper unit including a wiper cassette and a wiper holder to which the wiper cassette is attached, wherein the wiper cassette includes:

a long wiping member having a starting end and a terminating end at ends in a longitudinal direction and a wiping portion that is subjected to a tensile load at a position between the starting end and the terminating end, the long wiping member being wound from the terminating end in a roll;

a feeding roller retaining the long wiping member;

a take-up roller configured to take up the long wiping member from the starting end after the wiping portion wipes the liquid ejecting head;

a pressing portion pressing the wiping portion toward the liquid ejecting head on a transport route of the wiping member extending from the feeding roller to the take-up roller; and a case rotatably retaining the feeding roller and the take-up roller, the case retaining the pressing portion, and wherein the long wiping member has a single weak portion configured to be separated when the tensile load exceeds a threshold, and the single weak portion is located at a position between the feeding roller and the pressing portion on the transport route when the single weak portion is exposed.

9. The liquid ejecting apparatus according to claim 8, further comprising a controller that determines that the long wiping member is used up when the long wiping member is separated into a portion adjacent to the starting end and a portion adjacent to the terminating end at the weak portion.

10. The liquid ejecting apparatus according to claim 8, further comprising:

a load sensing mechanism configured to detect that the tensile load applied to the long wiping member is smaller than a reference value; and a controller configured to control the wiper unit, wherein the controller determines that the long wiping member is used up when the load sensing mechanism detects that the tensile load is smaller than the reference value.

11. The liquid ejecting apparatus according to claim 8, further comprising:

a rotation sensing mechanism configured to detect rotation of the feeding roller; and a controller configured to control the wiper unit, wherein the controller determines that the long wiping member is used up when the rotation sensing mechanism has stopped detecting rotation of the feeding roller while the take-up roller is rotating to take up the long wiping member.

12. The liquid ejecting apparatus according to claim 8, wherein the wiper cassette further includes a pair of rollers configured to sandwich the long wiping member and are located between the feeding roller and the pressing portion on the transport route, and the weak portion is located at a position between the feeding roller and the pair of rollers on the transport route when the weak portion is exposed.

13. A method of using a long wiping member, the long wiping member having a starting end and a terminating end at ends in a longitudinal direction, a wiping portion that is subjected to a tensile load at a position between the starting end and the terminating end, and a weak portion configured to be separated when the tensile load exceeds a threshold and located at a position closer than the wiping portion to the terminating end, the long wiping member being wound from the terminating end in a roll, the method comprising:

taking up the long wiping member after using the wiping portion for wiping a liquid ejecting head that ejects liquid to allow the wiping portion to shift toward the terminating end;

determining that the long wiping member is used up soon when the tensile load exceeds a second reference value lower than the threshold after the weak portion is exposed by taking up the long wiping member; and determining that the long wiping member is used up when the tensile load becomes smaller than the second reference value after exceeding the second reference value.

14. The method of using a long wiping member according to claim 13, wherein when the tensile load while using the wiping portion is a first reference value, determining that the long wiping member is used up when the tensile load becomes smaller than the first reference value after exceeding the second reference value.

* * * * *